US009459067B1

(12) United States Patent
Mason

(10) Patent No.: US 9,459,067 B1
(45) Date of Patent: Oct. 4, 2016

(54) CROSSBOW FLETCHING GROOVE AND METHOD THEREFORE

(71) Applicant: John E. Mason, Elizabethtown, IL (US)

(72) Inventor: John E. Mason, Elizabethtown, IL (US)

( * ) Notice: Subject to any disclaimer, the term of this patent is extended or adjusted under 35 U.S.C. 154(b) by 0 days.

(21) Appl. No.: 15/159,315

(22) Filed: May 19, 2016

Related U.S. Application Data

(60) Provisional application No. 62/163,613, filed on May 19, 2015.

(51) Int. Cl.
*F41B 5/18* (2006.01)
*F41B 5/12* (2006.01)
*F41B 5/14* (2006.01)

(52) U.S. Cl.
CPC ..... *F41B 5/12* (2013.01); *F41B 5/1469* (2013.01); *F41B 5/1403* (2013.01)

(58) Field of Classification Search
CPC ..... F41B 5/12; F41B 5/1469; F41B 5/1403
USPC ..... 124/25, 86
See application file for complete search history.

(56) References Cited

U.S. PATENT DOCUMENTS 2,842,114 A * 7/1958 Duncan ..... F41B 5/12 124/25
4,294,222 A * 10/1981 Pelsue ..... F41B 5/12 124/25
4,649,892 A * 3/1987 Bozek ..... F41B 5/10 124/25
4,719,897 A * 1/1988 Gaudreau ..... F41B 5/1469 124/25
4,732,134 A * 3/1988 Waiser ..... F41B 5/12 124/25
4,926,834 A * 5/1990 Chauvin ..... F41B 5/12 124/25
5,025,771 A * 6/1991 Hanson ..... F41B 5/1469 124/25
6,205,990 B1 * 3/2001 Adkins ..... F41B 5/12 124/25
7,017,568 B1 * 3/2006 Smith ..... F41B 5/1469 124/25
7,753,041 B2 * 7/2010 Ogawa ..... F41B 5/12 124/25
7,784,453 B1 * 8/2010 Yehle ..... F41B 5/12 124/25
8,104,461 B2 * 1/2012 Kempf ..... F41B 5/12 124/25
8,240,299 B2 * 8/2012 Kronengold ..... F41A 11/02 124/25
8,453,631 B1 * 6/2013 Kronengold ..... F41A 11/02 124/25
9,303,944 B2 * 4/2016 Barber ..... F41B 5/123
9,341,432 B1 * 5/2016 Wohleb ..... F16H 25/20
2010/0170489 A1 * 7/2010 Shepley ..... F41B 5/12 124/25
2016/0116243 A1 * 4/2016 Hughes ..... F41A 19/10 124/31
2016/0195354 A1 * 7/2016 Barnett ..... F41B 5/1403 124/25
2016/0195357 A1 * 7/2016 Barber ..... F41B 5/123 124/25

* cited by examiner

*Primary Examiner* — Alexander Niconovich
(74) *Attorney, Agent, or Firm* — Gary K. Price

(57) ABSTRACT

A modified fletching groove for a crossbow that assists with efficiently setting the crossbow into an armed or fully drawn position. The fletching groove includes at least one setting disposed between the rearward end and forward end of the crossbow stock. Each of the at least one settings define a path that includes at least a first direction and a second direction and a catch. The first direction preferably extends downwardly and slants towards the forward end of the stock, and the second direction preferably extends from the lower most end of the first direction, and upwardly extends at a slanted angle towards the forward end. The upwardly incline surface of the second direction is at substantially forty-five degrees relative to the top surface of the fletching groove. The second direction further defines an upper most end that includes the catch adjacent the upper most end. The at least one setting for receiving the crossbow bowstring at selected intervals along the length of the fletching groove.

18 Claims, 5 Drawing Sheets

CROSSBOW FLETCHING GROOVE AND METHOD THEREFORE

CROSS REFERENCES TO RELATED APPLICATIONS

U.S. Provisional Application for Patent No. 62/163,613, filed May 19, 2015, with title "Crossbow Fletching Groove and Method Therefore" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates generally to crossbows, and more particularly to a modified fletching groove that assists with efficiently setting a crossbow into an armed position.

2. Brief Description of Prior Art

Crossbows are well known projectile devices that have been around for centuries. During most of that time, the basic structure of the crossbow has remained relatively unchanged, with modifications to the trigger mechanism, changes in the materials used in the construction and various innovations in devices and mechanisms for drawing the bowstring into the cocked position. Time and effort has been expended on developing a simple and easily used cocking mechanism over the years. However, each has been less than satisfactory. The simplest and most common form of cocking is performed manually. The bowstring is grasped by hand or hands, and drawn to the cocked position. This method is relatively simple and quick, but becomes more difficult as the draw weight of the bow increases. Claws, hooks, etc. with handles are often utilized to provide a better grip on the bow string. However, strength is still needed to draw the bowstring.

Further, the performance of a crossbow can generally be measured by the speed of the arrow that is being propelled by the crossbow. This speed is dictated primarily by the length of the stroke that the arrow is pushed by the bowstring. Thus, the longer the barrel of the stock of a crossbow, the longer the stroke and faster the arrow resulting in a high performance crossbow.

As mentioned, the cocking of a crossbow has always been a problem and the longer the stock of high performance crossbows compounds that problem. That is, the longer the stock, the harder it is to cock the crossbow.

FIG. 1 depicts one of the problems associated with cocking a crossbow. Typically, when a crossbow is being cocked, the user places his foot in the stirrup and places the butt end of the crossbow against his torso, usually his chest. Then he bends over and grasps the bowstring and pulls it back to be engaged by the trigger. In this bent over position it is difficult to generate the sometimes extreme force necessary to cock a crossbow in one continuous effort.

Over the years external mechanical aids have also been developed to assist the user with cocking a crossbow. These, however, are typically bulky, difficult to use and inconvenient to carry with the crossbow.

As will be seen from the subsequent description, the preferred embodiments of the present invention overcome disadvantages of the prior art. In this regard, the present invention discloses a crossbow setting device to assist the user in fully cocking a crossbow.

SUMMARY OF THE INVENTION

A modified fletching groove for a crossbow that assists with efficiently setting the crossbow into an armed or fully drawn position. The modified fletching groove extends the approximate length of the stock of the crossbow. The fletching groove includes at least one setting disposed between the rearward end and forward end of the crossbow stock. The setting defines a path that includes at least a first direction and a second direction and a defined catch. The first direction preferably extends downwardly and slants towards the forward end of the stock, and the second direction preferably extends from the lower most end of the first direction, and upwardly extends at a slanted angle towards the forward end. The upwardly incline surface of the second direction is at substantially forty-five degrees relative to the top surface of the fletching groove. The second direction further defines an upper most end that includes the catch adjacent the upper most end. The at least one setting for receiving the crossbow bowstring at selected intervals along the length of the fletching groove.

DESCRIPTION OF THE PREFERRED EMBODIMENT

The device of the present invention is directed to a modified fletching groove for a crossbow that assists with efficiently selling the crossbow into an armed or fully drawn position. The fletching groove of the present invention is integral to the crossbow and extends the approximate length of the crossbow's stock. As a result, the present fletching groove is easy to use and is conveniently integral to the crossbow design. As will be described, the modified fletching groove as disclosed consists of components configured and correlated with respect to each other so as to attain the desired objective.

Figure 1:
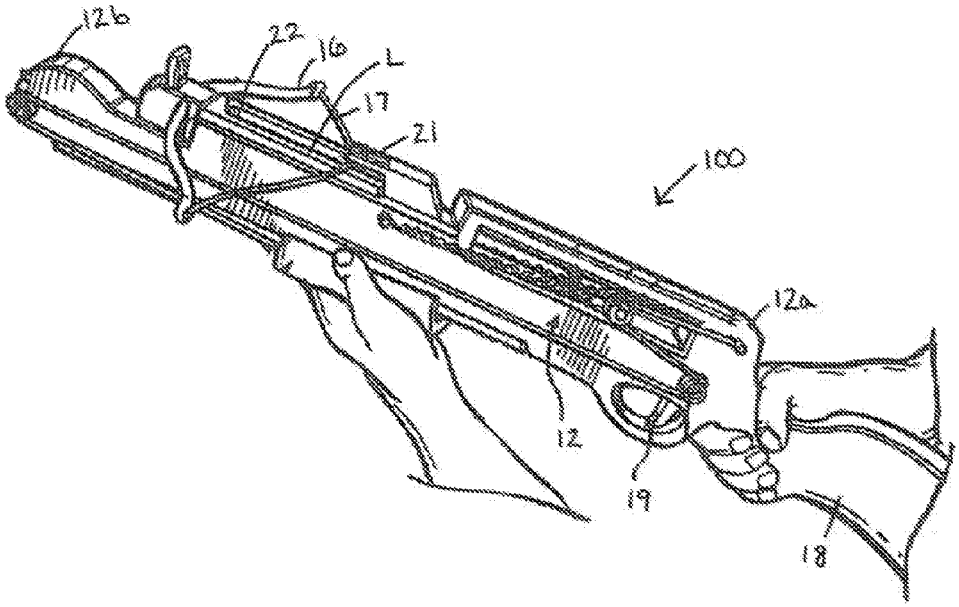
FIG. 1 is a perspective view of a crossbow of the prior art.
Figure 2:
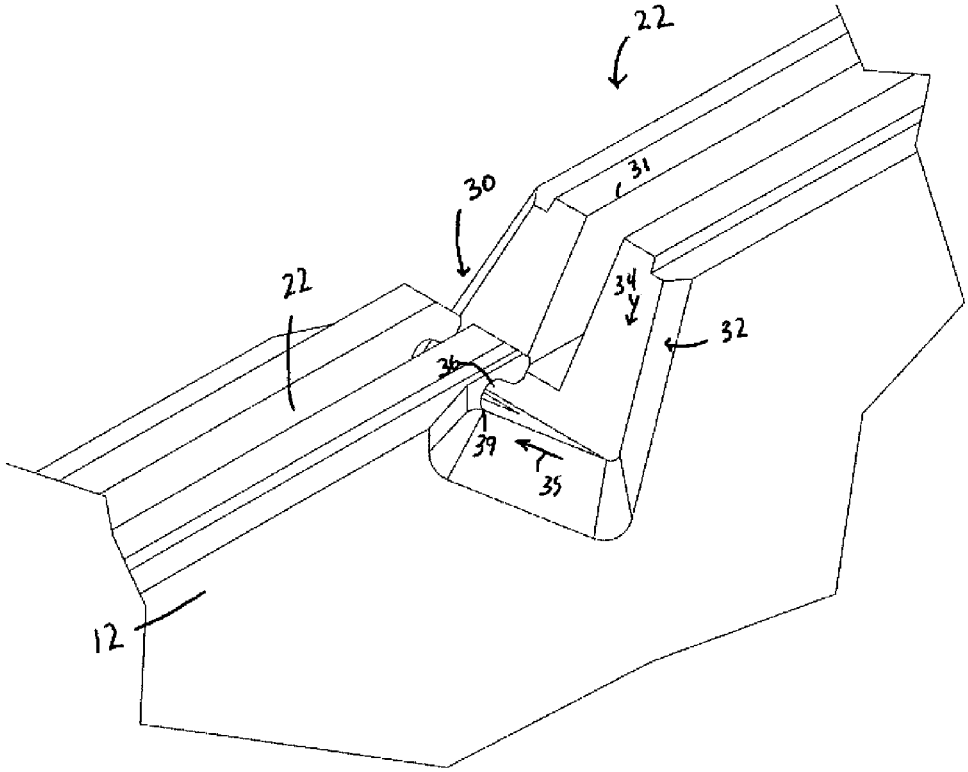
FIG. 2 is an enlarged front perspective view of a preferred embodiment of the present invention, a modified crossbow fletching groove.
Figure 3:
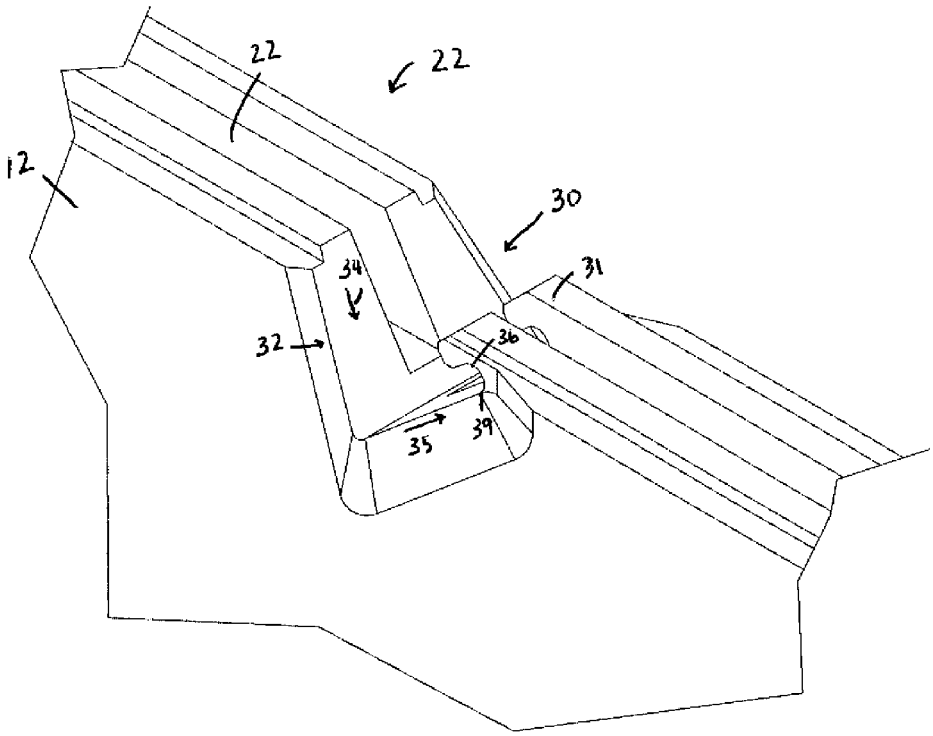
FIG. 3 is an enlarged rear perspective view of the modified crossbow fletching groove of FIG. 2.
Figure 4:
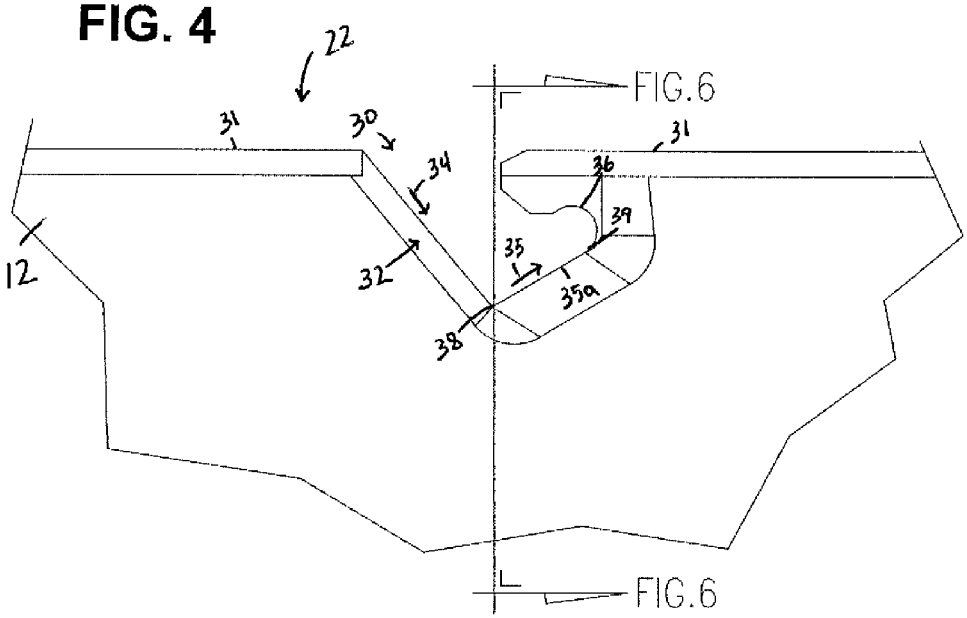
FIG. 4 is an enlarged side view of the modified crossbow fletching groove of FIG. 3
Figure 5:
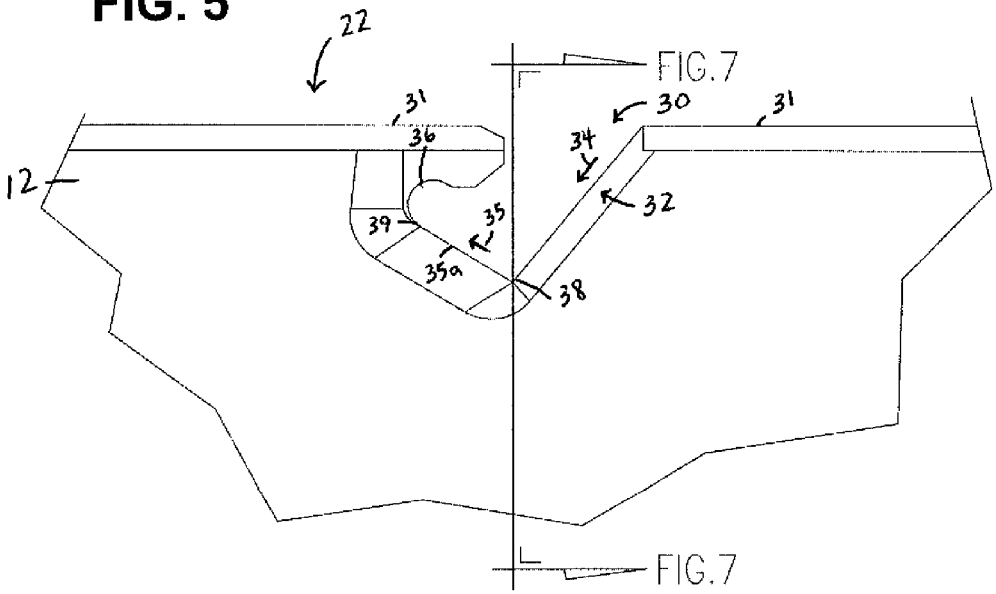
FIG. 5 is an enlarged side view of the modified crossbow fletching groove of FIG. 2.
Figure 6:
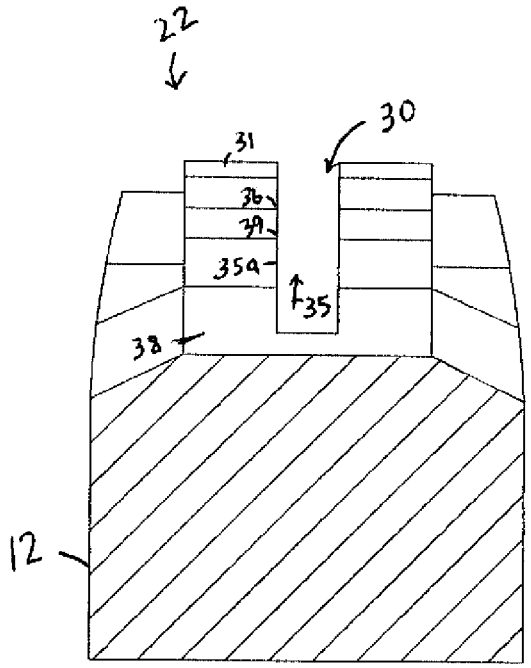
FIG. 6 is a sectional view thereof, taken from line 6-6 in FIG. 4.
Figure 7:
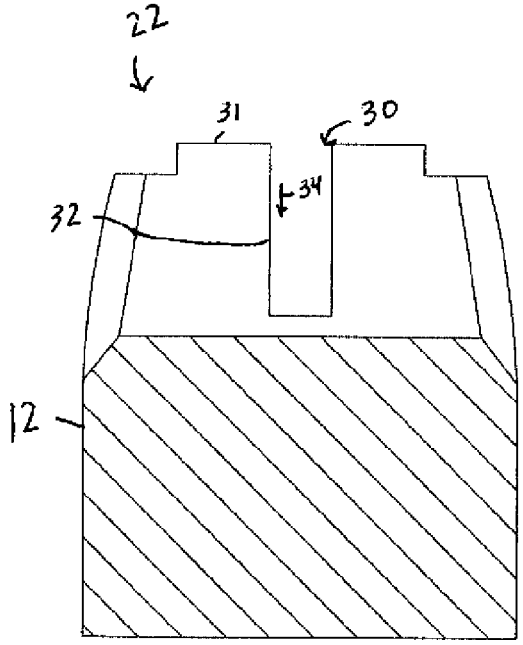
FIG. 7 is a sectional view thereof, taken from line 7-7 in FIG. 5.

Referring to FIG. 1, which illustrates a crossbow generally designated 100. Crossbow 100 is substantially of any conventional construction, and includes a rifle-style stock 12 having a rearward end 12*a* from which a butt portion 18 extends, and a forward end 12*b*. Stock 12 further includes slide or fletching groove 22 to mount a bolt and carries a bow 16 with bowstring 17 proximate the forward end 12*b*. As known, bowstring 17 is moveable between a released position and a drawn position whereby bowstring 17 is pulled toward rearward end 12*a*. A trigger mechanism is carried by stock 12 and includes a trigger 19 mounted proximate rearward end 12*a* and a latch 21. Latch 21 engages and retains bowstring 17 in the drawn position and releases bowstring 17 into the released position when disengaged from bowstring 17. Trigger 19 and latch 21 are not described in detail since substantially any trigger mechanism can be employed, and are well known in the art.

In application, an arrow having three fletchings rest on the fletching groove 22 that extends the approximate length of the stock 12. As is known, one of the fletchings of the arrow inserts into the fletching groove 22 of the stock 12.

From the outset, it should be understood that the present invention relates solely to a modified fletching groove that assists with efficiently setting a crossbow into an armed or fully drawn position. The present invention does not alter the known application of the prior art latch or trigger mechanism as described, nor the releasing or shooting the conventional crossbow. In this regard, the bolt or arrow is received in the fletching groove as known, the bowstring is grasped by hand or hands, and drawn towards the cocked position. However, as will be described the present device diminishes or even eliminates the difficulty and extreme force necessary to cock a crossbow in one continuous effort. Again, the above described cycle of operation in a crossbow is widely known and not altered by the present invention.

Referring to FIGS. 2-7, a preferred embodiment of the present invention is shown, a modified fletching groove for a crossbow designated as numeral 22. The modified fletching groove 22 that as earlier described, extends the approximate length of the stock 12. And, as is known, one of the fletchings of the arrow inserts into the fletching groove 22 of the stock 12.

The fletching groove 22 includes at least one setting generally designated as numeral 30, the setting 30 selectively disposed between the rearward end 12*a* and forward end 12*b* of the stock 12. In the preferred embodiment, the modified fletching groove 22 includes at least one setting 30 disposed along the length of the fletching groove 22 and preferably, one of the settings of the at least one setting 30 is disposed at a location L (see FIG. 1) approximately three quarter (¾) the length of the fletching groove 22, proximate the rearward end 12*a*.

As illustrated, the setting 30 defines a path 32 that includes at least a first direction (illustrated in FIGS. 4 and 5 with arrow 34) and a second direction (arrow 35) and a defined catch 36. The first direction 34 preferably extends downwardly and slants towards the forward end of the stock 12. The second direction 35 preferably extends from the lower most end 38 of the first direction, and upwardly extends at a slanted angle towards the forward end. In this embodiment of the setting 30, the incline surface 35A of the second direction 35 is at substantially forty-five degrees relative to the top surface 31 of the fletching groove 22. The second direction 35 further defines an upper most end 39 that includes the catch 36 adjacent the upper most end.

The at least one setting 30 as defined for receiving the bowstring 17 at selected intervals along the length of the fletching groove 22.

An advantage is provided by the arrangement of the at least one setting 30 as defined. In the preferred embodiment, as the bowstring is urged a certain distance towards the latch 21 and being fully drawn, the bowstring may be received within one of the settings 30 disposed along the length of the fletching groove 22, before reaching the latch 21. This reduces the effort needed to cock a crossbow in one continuous effort. Thus, a crossbow can be cocked in intervals, depending upon the number of settings 30 disposed along the length of the fletching groove 22, rather than the known difficulties of cocking a crossbow in one continuous effort.

The modified fletching groove 22 includes one setting 30 preferably disposed at location L approximately three quarter (¾) the length of the fletching groove 22. A more complex design having multiple settings 30 along the length of the fletching groove 22 can be employed to increase the advantage. Those skilled in the art will understand that the advantage created by the at least one setting 30 can be increased or eliminated as desired, according to the positioning of the at least one setting 30 along the length of the fletching groove 22.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A modified fletching groove for a crossbow comprising:

at least one setting fixed within a fletching groove and disposed between a rearward end and a forward end of a crossbow stock, wherein each of said at least one settings define a path that includes at least a first direction and a second direction and a catch, wherein said first direction extends downwardly from a top surface of the fletching groove and slants towards the forward end of the stock, and said second direction extends from a lower most end of the first direction, and upwardly extends defining an incline surface towards the forward end, and wherein the incline surface is at an approximate forty-five degrees relative to said top surface, said second direction further defines an upper most end in communication with said catch, wherein a trigger latch is positioned at a rear of the fletching groove and said at least one setting is positioned between the trigger latch and the forward end of the crossbow stock.

2. The fletching groove of claim 1, wherein said fletching groove extends an approximate length of the crossbow stock.

3. The fletching groove of claim 2, wherein said at least one setting is disposed at selected intervals along a length of the fletching groove.

4. The fletching groove of claim 3, wherein one of the at least one settings is disposed at a location approximately three quarter the length of the fletching groove, proximate the rearward end.

5. A modified fletching groove for a crossbow comprising:

at least one setting integral to a fletching groove and disposed along a length of a crossbow stock, wherein each of said at least one settings define a path that includes a catch, and wherein said at least one setting is disposed between a trigger latch disposed at a rear of the fletching groove and a forward end of the crossbow stock, and wherein said at least one setting for receiving the crossbow bowstring at selected intervals along a length of a fletching groove.

6. The fletching groove of claim 5, wherein said path defines a first direction that extends downwardly from a top surface of the fletching groove and slants towards the forward end of the crossbow stock.

7. The fletching groove of claim 6, wherein said path further defines a second direction that extends from a lower most end of the first direction, and upwardly extends defining an incline surface towards the forward end.

8. The fletching groove of claim 7, wherein said incline surface is at an approximate forty-five degrees relative to said top surface.

9. The fletching groove of claim 8, wherein said second direction further defines an upper most end in communication with said catch.

10. The fletching groove of claim 9, wherein said fletching groove extends an approximate length of the crossbow stock.

11. The fletching groove of claim 10, wherein said at least one setting is approximately three quarter the length of the fletching groove, proximate a rearward end of the crossbow stock.

12. A modified fletching groove for a crossbow comprising:

a setting integral to a fletching groove and disposed along a length of a crossbow stock, wherein said setting includes a catch fixed within the crossbow stock and in communication with a top surface, and wherein said setting is disposed between a crossbow trigger and a forward end of the crossbow stock and said setting sized for receiving a crossbow bowstring.

13. The fletching groove of claim 12, wherein said setting defines a path having a first direction that extends downwardly from said top surface and slants towards the forward end of the crossbow stock.

14. The fletching groove of claim 13, wherein said path further defines a second direction that extends from a lower most end of the first direction, and upwardly extends defining an incline surface towards the forward end.

15. The fletching groove of claim 14, wherein said incline surface is at an approximate forty-five degrees relative to said top surface.

16. The fletching groove of claim 15, wherein said second direction further defines an upper most end in communication with said catch.

17. The fletching groove of claim 16, wherein said fletching groove extends an approximate length of the crossbow stock.

18. The fletching groove of claim 17, wherein said fletchinq groove defines a length and said setting is approximately three quarter the length of the fletching groove, proximate a rearward end of the crossbow stock.

* * * * *